United States Patent [19]

Fitzgerald

[11] 3,964,259

[45] June 22, 1976

[54] MULTI CONDITION RELIEF VALVE

[75] Inventor: John B. Fitzgerald, St. Louis, Mo.

[73] Assignee: ACF Industries, Incorporated, New York, N.Y.

[22] Filed: Aug. 6, 1973

[21] Appl. No.: 385,967

[52] U.S. Cl. ..... 60/290

[51] Int. Cl.[2] ..... F02B 75/10

[58] Field of Search ..... 60/289, 290; 251/25; 92/416, 437; 123/117 A, 119 A

[56] References Cited

UNITED STATES PATENTS

| | | | |
|---|---|---|---|
| 2,650,581 | 9/1953 | Short | 123/117 A |
| 3,433,242 | 3/1969 | Voorheis | 60/290 |
| 3,479,816 | 11/1969 | Masters | 60/290 |
| 3,486,491 | 12/1969 | White | 123/117 A |
| 3,507,260 | 4/1970 | Walker | 123/119 A |
| 3,739,797 | 6/1973 | Caldwell | 123/119 A |
| 3,805,522 | 4/1974 | Sheppard | 60/290 |

*Primary Examiner*—Douglas Hart

[57] ABSTRACT

An automatically-actuated multi-condition relief valve for controlling flow of forced air to a combustion-engine exhaust pipe immediately upstream of an oxidizing catalytic converter, is described. The valve body has an inlet, an outlet and a bypass port. A single valve stem has a main valve head mounted thereon for controlling flow between the inlet and outlet ports and a bypass valve head for controlling flow between the inlet and the bypass ports. A valve-stem actuating means responds to intake manifold pressure of the combustion engine to allow a biasing means to close the main valve head and open the bypass valve head in response to either a low manifold vacuum — corresponding to a high engine acceleration — or a high manifold vacuum — corresponding to a rapid deceleration. Further, the valve stem actuating means responds to intermediate manifold vacuums to open the main valve and close the bypass valve.

The valve stem actuating means comprises a diaphragm having a manifold-vacuum chamber on one side thereof and a pressure-reference chamber on the other side thereof. An equalizing valve, which is actuated in response to a high manifold vacuum, controls air flow between these two chambers. The bypass-valve head is urged toward a bypass-valve seat by a release spring so that, even when the bypass-valve head is in a closed position, the high inlet-port pressure can open the by-pass valve head to relieve this pressure.

2 Claims, 4 Drawing Figures

MULTI CONDITION RELIEF VALVE

BACKGROUND OF THE INVENTION

Recently much attention has been focused on the problem of reducing pollution of the atmosphere, especially in and around large metropolitan areas. A great deal of effort has been expended on reducing pollutants emitted by factories, industrial installations and even homes. It has also been recognized that the emissions of internal combustion engines have been major sources of pollution, particularly in the form of unburned hydrocarbons, carbon monoxide and other noxious gases. The automotive industry has embarked on a large-scale program to reduce the noxious gases emitted by passenger cars and trucks. A number of different solutions to the problem have been explored and several different ones have been adopted at least in part.

One so called "third generation," solution to the problem involves the use of catalytic converters in an exhaust pipe to convert noxious gases to safer gases. There are basically two main types of such converters presently contemplated. An oxidizing catalytic conveter speeds up and completes the burning of hydrocarbons and carbon monoxide. A reducing catalytic converter removes oxygen from oxides of nitrogen. An oxidizing catalytic converter needs additional oxygen to function properly and this can be provided by an engine-driven air pump. The air pump forces air into an exhaust pipe of the engine immediately upstream of the oxidizing catalytic converter.

However, it is desirable to provide a control valve for controlling the flow of forced air to the exhaust pipe to avoid certain problems. One such problem arises because additional burning of gases in an oxidizing catalytic converter creates additional heat. If the increased heat becomes great enough there could be physical damage to the converter. Of course at lower speeds, and lower engine loads, such as is normally encountered in city driving, the heat level is quite moderate. Under heavier load conditions and higher speeds, such as is encountered in steady cruising at highway conditions, the heat can be, and normally is, much greater.

Still another problem area may arise during deceleration of a vehicle where injected air creates a violent type of burning in an exhaust system which, in some instances, results in audible afterfire. This is an objectionable noise and may create pressures that could be harmful to an exhaust system.

Yet another problem area arises during periods of high engine acceleration when so much fuel is in exhaust gases that injected air causes too large a "fire". Such a fire may damage a catalytic converter. Thus, a valve for controlling flow from an air pump to an exhaust pipe immediately upstream of an oxidizing catalytic converter should, ideally, cut off air flow during periods of high acceleration and high deceleration, and should reduce air flow during periods of high speeds. It is an object of this invention to provide such a valve assembly.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis being placed upon illustrating principles of the invention in a clear manner.

DESCRIPTION OF THE PREFERRED EMBODIMENT

Figure 1:
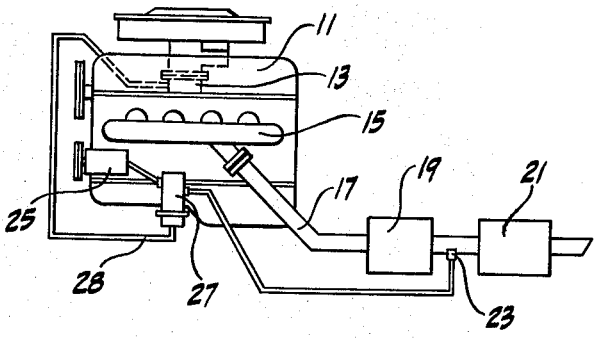
FIG. 1 is a schematic side elevation of a combustion engine including a valve assembly employing principles of this invention, with other elements, being depicted thereon in block diagram form.
Figure 2:
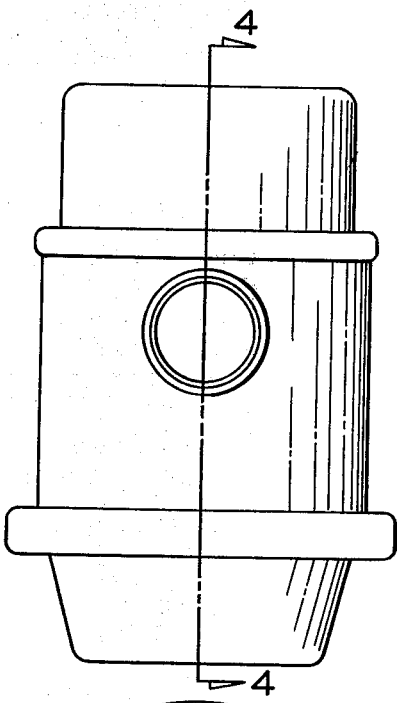
FIG. 2 is a side view taken from the outlet-port side, of a valve assembly employing principles of this invention.
Figure 3:
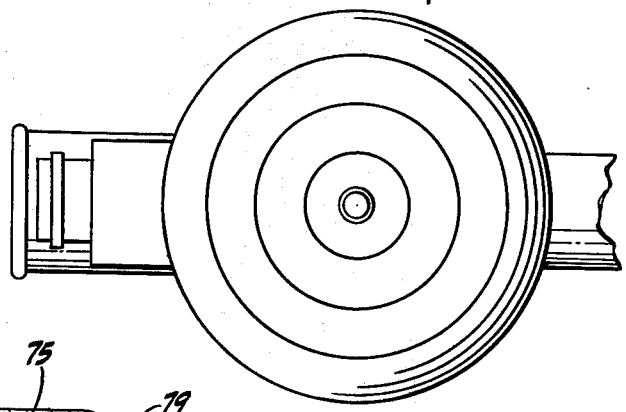
FIG. 3 is a bottom view of the valve assembly of FIG. 2.

Referring now to FIG. 1, a combustion engine 11 includes an intake manifold 13 (only partially shown), an exhaust manifold 15 and an exhaust pipe 17 leading from the exhaust manifold 15. First and second catalytic-converter beds 19 and 21 are connected in series along the exhaust pipe 17. The first catalytic converter bed 19 is a "reducing" type and is intended to break down nitrogen/oxygen compounds into nitrogen gas and oxygen gas. The second catalytic converter bed 21 is an "oxidizing" type and is intended to convert carbon monoxide (CO) into carbon dioxide ($CO_2$). The second catalytic converter bed 21 requires additional oxygen to function properly.

A system for injecting air into the exhaust pipe 17 at a point 23 is also depicted in FIG. 1. This system comprises an air pump 25, driven by the crankshaft of the combustion engine 11 via a belt, (not shown) and a valve assembly 27. This invention primarily concerns the valve assembly 27.

The valve assembly 27 is connected to the intake manifold 13 via a vacuum line 28, and the magnitude of vacuum in the vacuum line 28 controls flow of air through the valve assembly 27 from the air pump 25 to the exhaust pipe 17.

Figure 4:
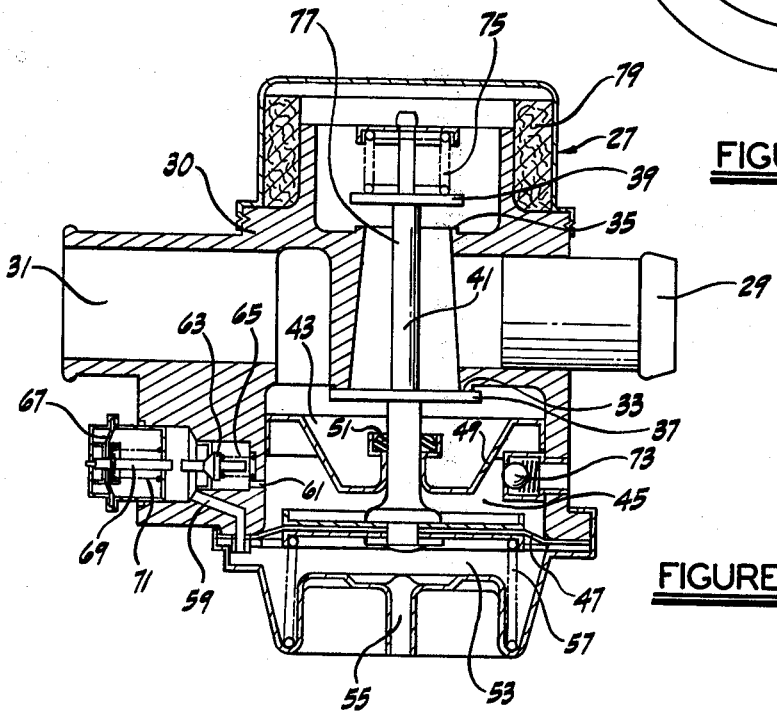
FIG. 4 is a sectional front view of the valve assembly of FIGS. 2 and 3 taken on line 4—4 in FIG. 2.

With reference to FIG. 4 the valve assembly 27 has a main body which defines an inlet port 29, an outlet port 31, a main valve seat 33 and a bypass valve seat 35. A main valve head 37 controls air flow through the main valve seat 33 and a bypass valve head 39 controls air flow through the bypass valve seat 35. The inlet port 29 is connected to the air pump 25 (FIG. 1) and the outlet port 31 is connected to the exhaust pipe 17 at point 23.

The main valve head 27 and the bypass valve head 39 are both mounted on a valve stem 41. The valve stem 41 extends through an intermediate chamber 43 and a vacuum reference chamber 45, whereat it is attached to a diaphragm 47. The diaphragm 47 is also attached around its periphery to the main body 30 of the valve assembly. The intermediate chamber 43 and the vacuum reference chamber 45 are separated by an impermeable panel 49 which makes sliding contact with the valve stem 41 at an imperfect O-ring seal 51.

On the other side of the diaphragm 47 from the vacuum reference chamber 45 is a manifold-vacuum chamber 53 which communicates via a manifold-vacuum inlet port 55 with the vacuum control line 29 (FIG. 1). A spring 57, located in the manifold vacuum chamber 53, biases the valve stem 41 so that the main valve head 37 is seated on the main valve seat 33 and the bypass valve head 39 is held away from the bypass valve seat 35.

Air is allowed to flow between the manifold-vacuum chamber 53 and the vacuum reference chamber 45 via two serially connected equalizing passages 59 and 61 under the control of a equalizing valve head 63. An equalizing valve spring 65 urges the equalizing valve head 63 toward a seat to cut off such air flow. However, a control diaphragm 67, an attached control stem 69, and a control spring 71 are designed to open the equalizing valve head 63 under high vacuum conditions in the manifold vacuum chamber 53, as will be described below.

A ball check valve 73 allows air to escape from the vacuum reference chamber 45 and thereby limits the maximum pressure in the vacuum reference chamber 45 to a small amount above atmospheric pressure. It should be noted that air leakage through the imperfect O-ring seal 51 drives the vacuum reference chamber 45 to this pressure under normal conditions.

The bypass valve head 39 is slidably mounted on the valve stem 41 and is biased by a relief spring 75 toward the bypass valve seat 35. However, an enlarged portion 77 of the valve stem 41 limits movement of the bypass valve head 39. This structure allows the bypass valve head 39 to function as a relief valve when the valve stem 41 is moved downwardly, as seen in FIG. 4, to relieve pressure at the inlet port 29. Air which escapes in this manner through the bypass valve seat 35 is allowed to pass to atmosphere through a muffler element 79 to reduce noise.

In operation, pressurized air is applied to the inlet port 29 by the air pump 25. Under normal engine operation, for example, when a vehicle is being driven at a moderate steady speed, the vacuum applied to the manifold vacuum chamber 53 by the vacuum line 28 is between about 3 and 18 inches of mercury. Under these conditions, the vacuum difference between the manifold vacuum chamber 53 and the vacuum reference chamber 45 is sufficiently great to overcome the spring 57 and move the valve stem 41 downwardly, as seen in FIG. 4, so that the bypass valve head 39 is seated and the main valve head 37 is unseated. In this configuration, air travels through the inlet port 29, the main valve seat 33, outlet port 31, and is injected into the exhaust pipe 17 at point 23.

However, assuming that a driver of a vehicle suddenly takes his foot from an accelerator pedal and thereby decelerates the combustion engine 11; vacuum in the manifold vacuum chamber 53 falls below 3 inches of mercury, for example. At this point, the vacuum acting through the first equalizing passage 59 causes the control stem 69 to move to the right, as viewed in FIG. 4, sufficiently far to impinge on the equalizing valve head 63. This, in turn, opens the equalizing valve head 63 and equalizes the pressures between the manifold-vacuum chamber 53 and the vacuum reference chamber 45. Thus, the vacuum in the manifold-vacuum chamber 53 no longer has an appreciable effect on the diaphragm 47 and the spring 57 is thereby allowed to move the valve stem 41 upwardly to close the main valve head 37 and open the bypass valve head 39 to prevent afterfires in the exhaust pipe 17.

Now assuming conditions of rapid acceleration of the combustion engine 11, the vacuum appearing in the manifold-vacuum chamber 53 drops to a relatively low vacuum, for example, 18 to 25 inches of mercury, which is insufficient to overcome the spring 57. The spring 57 again closes the main valve head 37 and opens the bypass valve head 39. Thus, excess fuel is prevented from burning up the oxidizing catalytic converter bed 21.

Next, assuming that the vehicle is driven at a fast steady-state speed. Under this condition a moderate vacuum appears in the manifold-vacuum chamber 53 to hold the valve stem 41 down so that the main valve head 37 is open and the bypass valve head 39 is closed. However, as engine speed is increased the speed at which the combustion engine 11 drives the air pump 25 is also increased so that the air pump 25 increases the pressure at the inlet port 29. Eventually this pressure becomes so great that the bypass valve head 39 opens against the relief spring 75 to release some of this pressure. Thus, at a predetermined high steady-state speed the air pressure appearing at the outlet port 31 is stabilized so that only a predetermined maximum amount of air is injected into the exhaust pipe 17. Thus, an amount of air which would cause a sufficient "fire" in the oxidizing catalytic converter bed 21 to damage it is not injected into the exhaust pipe 17.

It should be understood by those skilled in the art that the valve assembly described herein cuts off a flow of air injected into an exhaust pipe under conditions of both high acceleration and high deceleration; and in addition, limits the amount of air injected into an exhaust pipe under a steady-state high speed.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege is claimed are defined as follows:

1. For use in a combustion engine exhaust system of the type wherein forced air is injected into an exhaust pipe through a forced-air passage, an automatically-actuated bypass valve for controlling the flow of said forced-air through said forced-air passage, said automatically-actuated bypass valve comprising:

a valve body having inlet, outlet and bypass ports, said inlet port for communicating with a forced-air source, said outlet port for communicating with said exhaust pipe, and said bypass port for communicating with atmosphere;

a main valve seat located between said inlet and outlet ports;

a bypass-valve seat located between said inlet and bypass ports;

a passage between said seats;

a valve stem located in said passage having affixed thereto a main valve head and a bypass valve head, one for each of the respective seats;

a valve-stem actuating means for holding said valve stem in a position wherein said main valve head is unseated and said bypass valve head is seated under conditions of steady state combustion engine speeds but for responding to high engine accelerations, and high engine decelerations by moving said valve stem to a position where said main valve head is seated and said bypass valve head is unseated;

said valve-stem actuating means further comprising a diaphragm assembly secured to an end of said stem, a first biasing means for urging said diaphragm assembly toward a main-valve-head-seated position, said diaphragm assembly being secured to said valve body, with said valve body defining a manifold-vacuum chamber for communicating with an inlet manifold of said combustion engine on one side of said diaphragm assembly and a reference vacuum chamber on the other side of said diaphragm assembly, said manifold-vacuum chamber and said reference vacuum chamber communicating with one another via an equalizing passage; and, an equalizing valve located in said equalizing passage including a second biasing means for biasing said equalizing valve toward a closed position, and an equalizing valve actuating means for opening said equalizing valve in response to an increase in vacuum by a predetermined amount in said manifold-vacuum chamber;

wherein a low manifold vacuum corresponding to a high acceleration of said combustion engine, in said manifold-vacuum chamber is insufficient to overcome said first biasing means and said first biasing means maintains said main valve head in a closed position, a high manifold vacuum, corresponding to a high deceleration of said combustion engine, acts on said equalizing-valve actuating means to open said equalizing valve so that said first biasing means maintains said main valve head in a closed position and, intermediate manifold-vacuums corresponding to intermediate steady-state speeds of said combustion engine act on said diaphragm to overcome said first biasing means and open said main valve.

2. In a combustion engine exhaust system as claimed in claim 1 wherein said automatically-actuated bypass valve further includes a resilient mounting means for mounting said bypass valve head on said valve stem for allowing said bypass valve head to open in response to a predetermined high pressure in said inlet port when said valve stem is in a main-valve-head-open position.

* * * * *